US009511254B2

(12) United States Patent
Netter et al.

(10) Patent No.: US 9,511,254 B2
(45) Date of Patent: Dec. 6, 2016

(54) DESK WORKSTATION WITH AN INTEGRATED TREADMILL

(71) Applicants: Jean Patrick Netter, Malibu, CA (US); Clifford Ames, Jr., Burbank, CA (US); Craig Darryl Landfair, Little Rock, AR (US)

(72) Inventors: Jean Patrick Netter, Malibu, CA (US); Clifford Ames, Jr., Burbank, CA (US); Craig Darryl Landfair, Little Rock, AR (US)

(73) Assignee: SmartMuv Wellness, Inc., Malibu, CA (US)

( * ) Notice: Subject to any disclaimer, the term of this patent is extended or adjusted under 35 U.S.C. 154(b) by 0 days.

(21) Appl. No.: 14/822,692

(22) Filed: Aug. 10, 2015

(65) Prior Publication Data

US 2016/0038785 A1 Feb. 11, 2016

Related U.S. Application Data

(60) Provisional application No. 62/035,260, filed on Aug. 8, 2014.

(51) Int. Cl.
*A63B 22/02* (2006.01)
*A63B 24/00* (2006.01)
(Continued)

(52) U.S. Cl.
CPC ..... *A63B 22/0235* (2013.01); *A47B 21/02* (2013.01); *A47B 21/04* (2013.01); *A47B 21/06* (2013.01); *A47B 83/001* (2013.01); *A63B 22/0285* (2013.01); *A63B 24/0087* (2013.01); *A47B 2021/068* (2013.01); *A47B 2220/06* (2013.01); *A63B 2210/50* (2013.01); *A63B 2225/20* (2013.01); *A63B 2225/50* (2013.01); *A63B 2225/685* (2013.01); *A63B 2230/01* (2013.01)

(58) Field of Classification Search
USPC ..... 482/54
See application file for complete search history.

(56) References Cited

U.S. PATENT DOCUMENTS 7,780,578 B2 * 8/2010 Packham ..... A63B 22/02 482/4
2006/0247109 A1 * 11/2006 Powell ..... A63B 71/0622 482/148

(Continued)

*Primary Examiner* — Stephen Crow
(74) *Attorney, Agent, or Firm* — Steven C. Sereboff; SoCal IP Law Group LLP

(57) ABSTRACT

A treadmill and desk assembly which allows a user to comfortably exercise while simultaneously running or walking. The desk includes a work panel, an adjustable leg, and a base frame. The work panel is connected normal to the adjustable leg, which in turn is connected to and supported by the base frame. The treadmill includes a first guiding member, a second guiding member, a front housing, a belt, a front roller, and a rear roller. The first guiding member and the second guiding member are adjacently connected to the front housing. The front roller and the rear roller are connected in between the first guiding member and the second guiding member. The belt is tensionably positioned about the front roller and the rear roller, thus allowing for relative rotation. The front housing is sized to fit and interlock with a treadmill-receiving cavity of the desk.

15 Claims, 12 Drawing Sheets

(51) Int. Cl.

| | |
|---|---|
| ***A47B 21/02*** | (2006.01) |
| ***A47B 21/06*** | (2006.01) |
| ***A47B 21/04*** | (2006.01) |
| ***A47B 83/00*** | (2006.01) |

(56) References Cited

U.S. PATENT DOCUMENTS

| | | | | |
|---|---|---|---|---|
| 2008/0255794 | A1* | 10/2008 | Levine | A61B 5/1118 702/141 |
| 2012/0088633 | A1* | 4/2012 | Crafton | A63B 22/0235 482/1 |
| 2012/0174833 | A1* | 7/2012 | Early | A47B 9/00 108/50.11 |
| 2014/0360413 | A1* | 12/2014 | Schenk | A47B 87/002 108/50.11 |
| 2015/0120377 | A1* | 4/2015 | Marvit | G06Q 30/0201 705/7.29 |
| 2015/0251047 | A1* | 9/2015 | Maaniitty | A47B 21/02 482/54 |
| 2015/0351553 | A1* | 12/2015 | Herring | A47C 7/62 482/54 |

* cited by examiner

Detail A

Detail A

DESK WORKSTATION WITH AN INTEGRATED TREADMILL

The current application claims a priority to the U.S. Provisional Patent application Ser. No. 62/035,260 filed on Aug. 8, 2014. The current application is filed on Aug. 10, 2015 while Aug. 8, 2015 was on a weekend.

FIELD OF THE INVENTION

The present invention generally relates to a desk assembly with a treadmill that is integrated and ergonomic. The desk assembly contains a plurality of accessories that are commonly used to increase the functionality of the desk as well as allow a user to interact with the integrated treadmill exercise machine. The treadmill is collapsible which allows it to be stored underneath the desk in an efficient manner.

BACKGROUND OF THE INVENTION

A treadmill is an exercise machine orientated about letting a person walk or run in place at a certain pace. Initially introduced as means for harnessing power from animals or humans, these highly popular machines are now utilized as exercise machines in gyms and households. The majority of treadmills provide the user with a moving platform, a belt driven by a motor, which requires the user to move at an equivalent rate the opposite direction and thus simulating walking and running. Treadmills provide a means for a person to get a quick run in without ever leaving the house. Additionally, treadmills are also extremely useful in facilities such as hospitals, rehabilitation centers, medical clinics, biomechanics institutes, test facilities and training facilities.

In recent years, a popular trend has arisen characterized by executing multiple tasks simultaneously in order to save time and increase productivity. A common trend running parallel to this is the incorporation of desk like modules into treadmills to allow users to simultaneously walking/running and performing a secondary task such as reading, watch televisions, working on a computer, and similar tasks. The problem with these new treadmill systems is that they are bulky, aesthetically challenged, and lack in versatility. The present invention provides an ergonomic and aesthetic desk with an integrated treadmill which incorporates wireless communication technology, a plurality of electronic accessories, and a convenient means for storage. Additionally, the present invention utilizes a significantly thicker and wider belt to increase the comfort level and the lateral contact surface for the user, ideal characteristics for prolonged activities. Furthermore, the treadmill may be folded upwards underneath the desk when not in use.

DETAIL DESCRIPTIONS OF THE INVENTION

All illustrations of the drawings are for the purpose of describing selected versions of the present invention and are not intended to limit the scope of the present invention.

The present invention is a system and method for a combination desk and treadmill work station. Through the incorporation of a low speed treadmill into a desk assembly, the functionality of the present invention is only limited by a user's ability to multitask. The present invention is predominantly designed to allow the user to casually walk on the treadmill while also performing mental activities such as work, homework, browsing the Internet, or playing video games. In general, the present invention provides is a versatile apparatus which allows the user to sit, stand, walk, work, and play. Additionally, the design of the present invention allows the user to easily store the treadmill underneath the desk in a discreet manner such that the user may utilize the desk assembly with a chair or while standing up.

Figure 1:
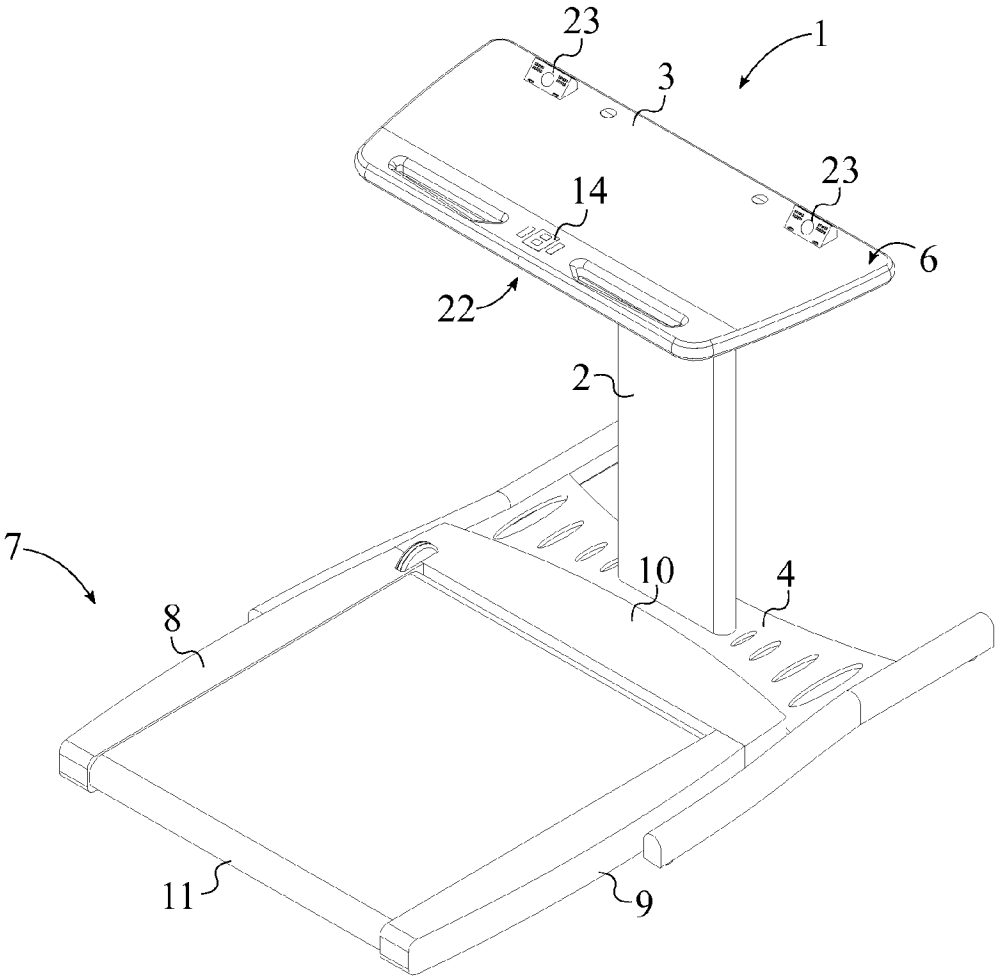
FIG. 1 is a perspective view of the present invention.

In general, referring to FIG. 1, the present invention comprises a desk 1 and a treadmill 7. The desk 1 comprises a work panel 3, an at least one adjustable leg 2, a base frame 4, and a treadmill-receiving cavity 5. The work panel 3 acts as a working surface for a user to write and work on. The at least one adjustable leg 2 and the base frame 4 act as the support structure for the work panel 3. The at least one adjustable leg 2 is oriented normal to and is adjacently connected to the work panel 3. The at least one adjustable leg 2 provides vertical support for the work panel 3 and allows the user to adjust the height of the work panel 3 to his or her preference. The base frame 4 is adjacently connected to the at least one adjustable leg 2, opposite the work panel 3, and preferably includes a multitude of lateral extensions for additional structural integrity. The treadmill-receiving cavity 5 laterally traverses into the base frame 4 and is shaped/sized to receive the treadmill 7. The treadmill-receiving cavity 5 allows the treadmill to interlock into the base frame 4, positioning the treadmill 5 directly underneath the desk 1.

Figure 7:
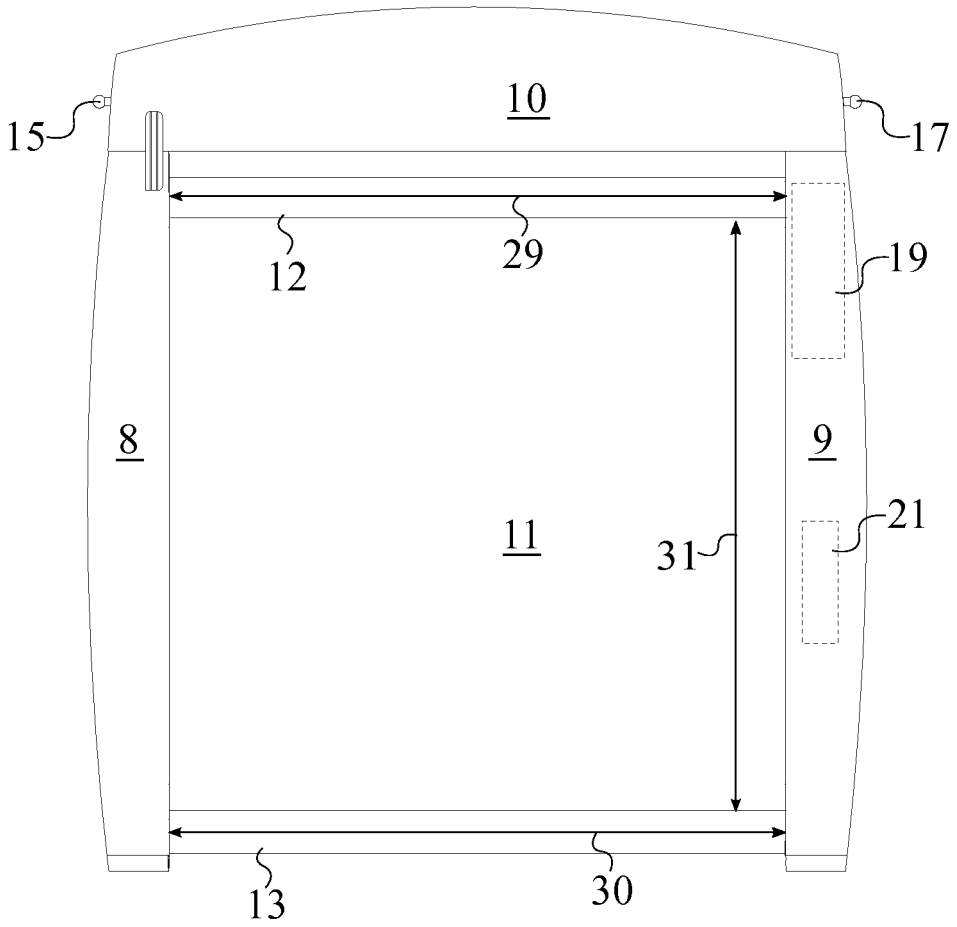
FIG. 7 is a top view of the treadmill without a belt 11, depicting a front roller 12 and the rear roller 13.

The treadmill 7 comprises a first guiding member 8, a second guiding member 9, a front housing 10, a belt 11, a front roller 12, and a rear roller 13. The front housing 10 is preferably a rectangular extrusion spanning the distance of the treadmill-receiving cavity 5. The first guiding member 8 and the second guiding member 9 are adjacently connected to the front housing 10, oriented perpendicular to the front housing 10. More specifically, the first guiding member 8 and the second guiding member 9 are oriented parallel to each other; and offset from each other, across the front housing 10 as seen in FIG. 7. Resultantly, the front housing 10, the first guiding member 8, and the second guiding member 9 form a U-shaped structure which houses and supports the belt 11 and the components necessary to rotate the belt 11. The front roller 12 and the rear roller 13 are rotationally mounted in between the first guiding member 8 and the second guiding member 9. In particular, the front roller 12 is positioned adjacent to the front housing 10, and the rear roller 13 is positioned opposite to the front housing 10. The front roller 12 and the rear roller 13 support the belt 11 and allow for relative rotation of the belt 11. The belt 11 is tensionably positioned about the front roller 12 and the rear roller 13, thus allowing the user to walk or run in place. The treadmill 7 is removably attached to the desk 1. More specifically, the front housing 10 is positioned within the treadmill-receiving cavity 5 and is removably attached to the base frame 4 to allow the user to remove treadmill 7 for storage purposes.

Figure 6:
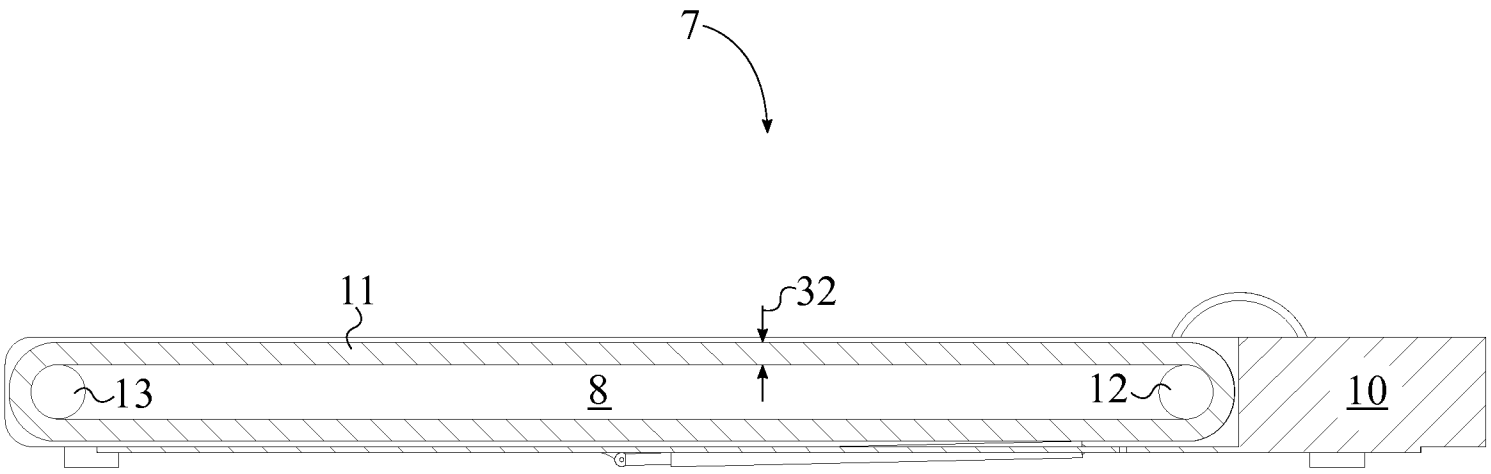
FIG. 6 is a sectional view taken about line A-A in FIG. 5.

The treadmill 7 is preferably designed to be more of a square-based design rather than traditional elongated rectangles to ensure that the user does not accidentally walk off the belt 11 while concentrating on their work or performing other secondary tasks on the work panel 3. The design of the treadmill 7 allows the user to walk for an extended period of time with confidence that he or she will not fall off or step on either the first guiding member 8 or the second guiding member 9. This design is achieved through the sizing and manipulation of a length 29 of the front roller 12, a length 30 of the rear roller 13, and an offset distance 31 between the front roller 12 and the rear roller 13. More specifically, a ratio between the offset distance 31 and the length 29 of the front roller 12 is a range from 0.75:1 to 1:1. Similarly, a ratio between the offset distance 31 and the length 30 of the rear roller 13 is a range from 0.75:1 to 1:1. Furthermore, the preferred length 29 of the front roller 12 is equal to the length 30 of the rear roller 13. This design results in a substantially wider design for the belt 11 when compared to traditional treadmills; although, alternative proportions and dimensions may be used as well to suit the preferences of the user. The length 29 of the front roller 12 and the length 30 of the rear roller 13 are preferably 30 inches and the offset distance 31 between the front roller 12 and the rear roller 13 is preferably 38 inches. Additionally, a wider belt 11 creates a more compact treadmill 7, thus requiring less space for storage. The belt 11 is also preferably designed for prolonged and continuous use. One of the main ways this is achieved is by increasing a thickness 32 of belt 11 as seen in FIG. 6. It is preferred that the thickness 32 of the belt 11 ranges between three fourths of an inch to one and three fourths of an inch. The belt 11 is also preferably composed of a relatively soft material such that the belt 11 acts as a shock absorber in order to allow the user to walk for extended periods of time without applying stress to the joints of the leg. The preferred material composition is rubber, although alternative materials may be used including, but not limited to, composite material, organic fiber, carpet fabric, and other comparable materials which deform to a certain extent under the user's foot.

Figure 10:
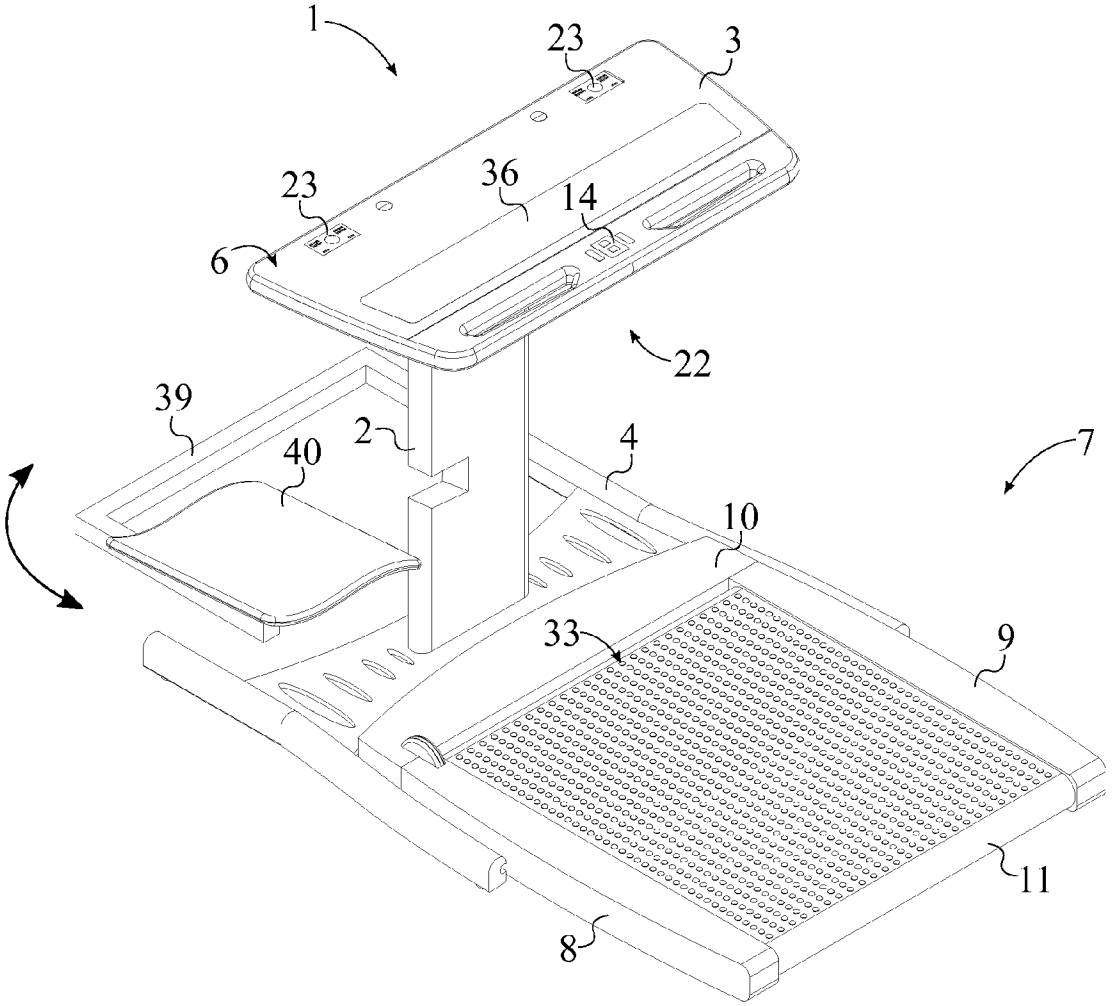
FIG. 10 is a perspective view of an alternative embodiment of the present invention.

In one embodiment, the belt 11 is composed of an Astroturf material which simulates a grass like texture. In another embodiment of the present invention, the treadmill 7 comprises a plurality of soft protrusions 33 for reflexology purposes. The plurality of soft protrusions 33 is externally distributed across the belt 11 and is externally connected to the belt 11 as seen in FIG. 10. The number and density of the plurality of soft protrusions 33 may vary to accommodate user preferences. Additionally, the shape and design of the each of the plurality of soft protrusions 33 may vary as well; one particular design is a semi-circular dome-like protrusion as seen in FIG. 10. The plurality of soft protrusions 33 stimulate and applies pressure to the bottom portion of the user's feet in order to massage the feet, promote blood circulation, and reduce stress.

The present invention also includes a motor 19, a control panel 14, a first wireless communication device 20, and a second wireless communication device 21. The motor 19 drives the rotational motion for the treadmill 7. Specifically, the motor 19 is mounted within the first guiding member 8, adjacent to the front roller 12. To rotate the belt 11, the motor 19 is torsionally coupled to the front roller 12, thus allowing to rotate the belt 11 through the application of a torque onto the front roller 12. Alternatively, the motor 19 may be axially coupled to the rear roller 13 and mounted within the second guiding member 9. The motor 19 is regulated and set by the control panel 14. The control panel 14 is integrated into a top surface 6 of the work panel 3 and may contain an ON/Off button, a speed adjuster buttons, level adjuster buttons, volume controls, sound adjusters and configuration buttons, an emergency shut off button, wireless communication pairing lights and configurations, and other similar buttons associated with traditional treadmills. The control panel 14 may also contain a digital screen which conveys information about the status of the present invention; including, but not limited to, current speed, calories burned, current time, time run, power produced, and other similar characteristics that may be utilized in the present invention. The control panel 14 is preferably situated closer to the user; this is in no way meant to limit the scope of the present invention and, as such, the control panel 14 may be incorporated into other regions of the work panel 3. The electronics associated with the control panel 14 are housed either inside or underneath the work panel 3, out of sight from the user.

Figure 11:
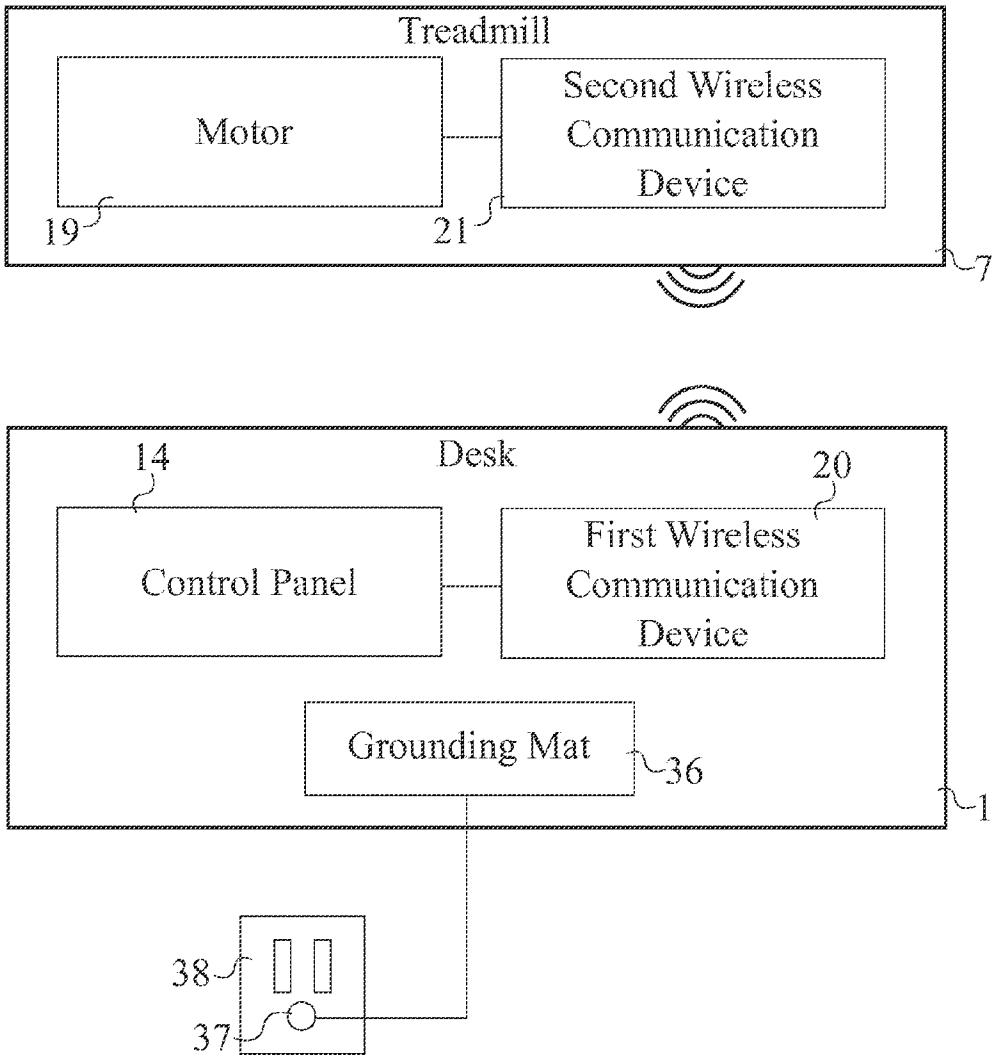
FIG. 11 is a schematic diagram of the present invention depicting the necessary components required for the wireless communication between the desk and the treadmill as well as the necessary components required for the grounding technology utilized in the present invention.

The control panel 14 and the motor 19 are communicably coupled by the first wireless communication device 20 and the second wireless communication device 21 as seen in FIG. 11. The first wireless communication device 20 is integrated into the work panel 3 and is electronically connected to the control panel 14. Similarly, the second wireless communication device 21 is integrated into the treadmill 7 and is electronically connected to the motor 19. The second wireless communication device 21 is communicably coupled to the first wireless communication device 20, thus allowing the control panel 14 to regulate the functions and settings of the motor 19. Additionally, the first wireless communication device 20 and the second wireless communication device 21 may be used to connect the present invention to external devices such as smartphones, laptops, and other computing devices. The external devices may be used to control the present invention and read information provided by the present invention as well as perform a variety of alternative integrated functions.

The present invention incorporates a height adjustment feature for the work panel 3 that allows the user to raise and lower the work panel 3 to his or her preference. This is accomplished by the at least one adjustable leg 2. The preferred design for the at least one adjustable leg 2 is a telescoping shaft with an integrated height adjustment mechanism; mechanisms include, but are not limited to, a crankshaft, hydraulics, springs, electric motors, pneumatic based mechanisms, pin-slot mechanisms, and other comparable means.

Figure 2:
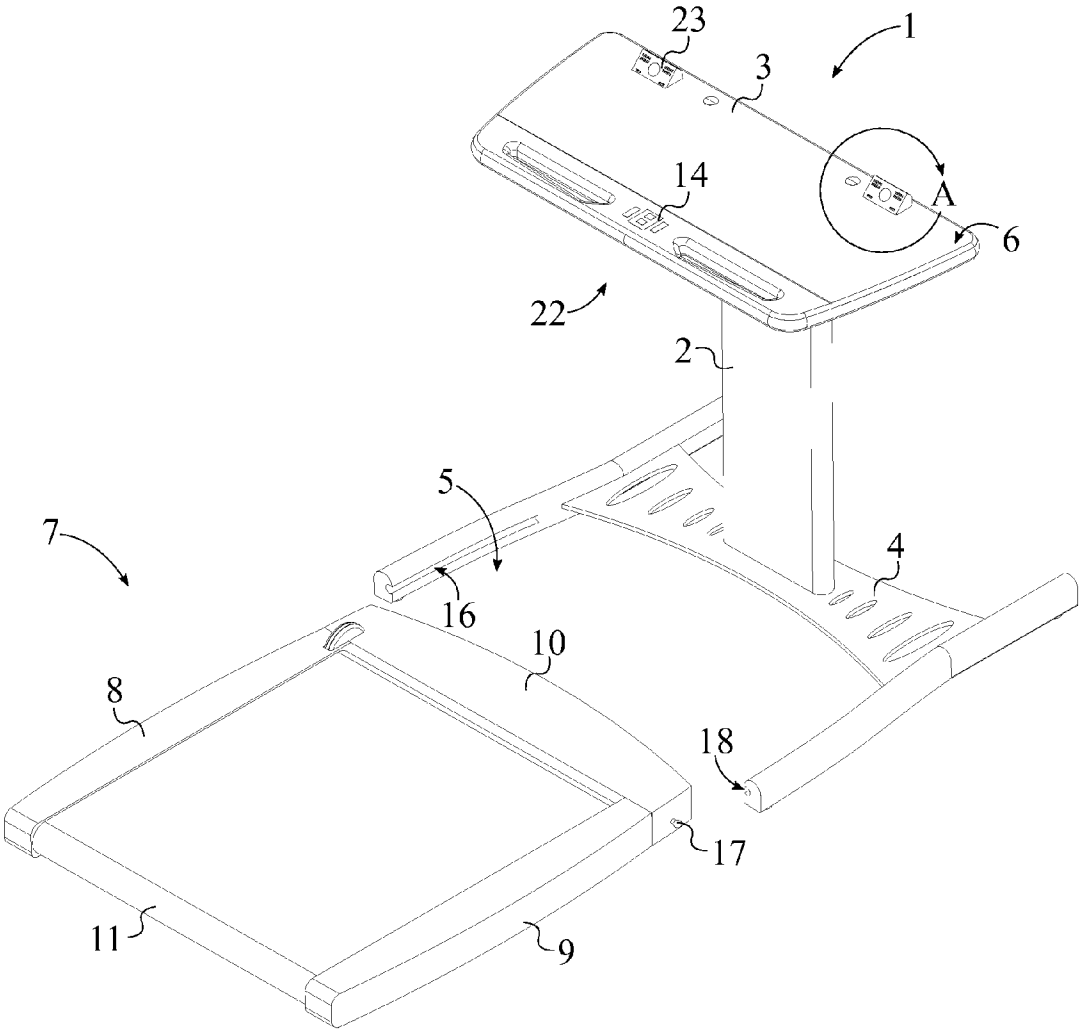
FIG. 2 is a partially exploded perspective view of the present invention.
Figure 5:
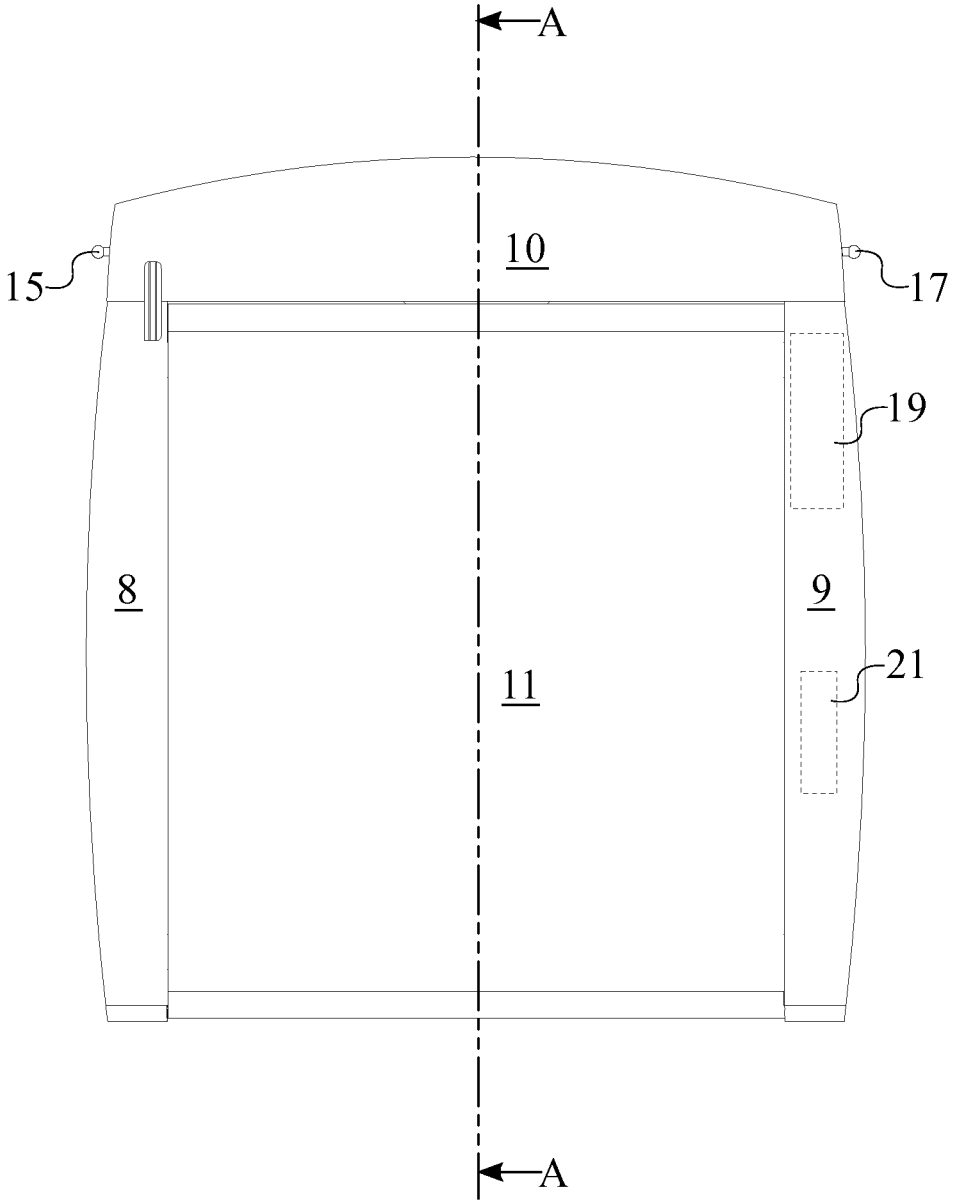
FIG. 5 is a top view of a treadmill.

Referring to FIG. 2 and FIG. 5, the desk 1 and the treadmill 7 are attached to each other through the use of a first engagement element 15, a second engagement element 16, a third engagement element 17, and a fourth engagement element 18. Attaching the treadmill 7 to the desk 1 prevents movement of the treadmill 7 relative to the desk 1. Additionally, the treadmill 7 may be fully removed from the desk 1 and stored without any tools or cumbersome procedures. The first engagement element 15 and the third engagement element 17 are preferably a circular extrusion with a dome-shaped tip as seen in FIG. 5. The first engagement element 15 is laterally connected to the front housing 10, adjacent to the first guiding member 8. Similarly, the third engagement element 17 is laterally connected to the front housing 10, adjacent to the second guiding member 9. The second engagement element 16 and the fourth engagement element 18 are preferably track-type cutouts that are shaped and sized to receive the first engagement element 15 and the third engagement element 17, respectively. The second engagement element 16 laterally traverses into the base frame 4 from the treadmill-receiving cavity 24 5, adjacent to the first engagement element 15. In a similar fashion, the second engagement element 16 laterally traverses into the base frame 4 from the treadmill-receiving cavity 5, adjacent to the third engagement element 17. When the treadmill 7 is attached to the desk 1, the first engagement element 15 is interlocked into the second engagement element 16 and the third engagement element 17 is interlocked into the fourth engagement element 18. The rail-track type attachment method allows for easy and quick detachment and attachment of the treadmill 7 and the desk 1, although alternative mechanisms may also be utilized for the present invention. In alternative embodiments of the present invention, a locking mechanism may be used to further secure the treadmill 7 and the desk 1.

Figure 8:
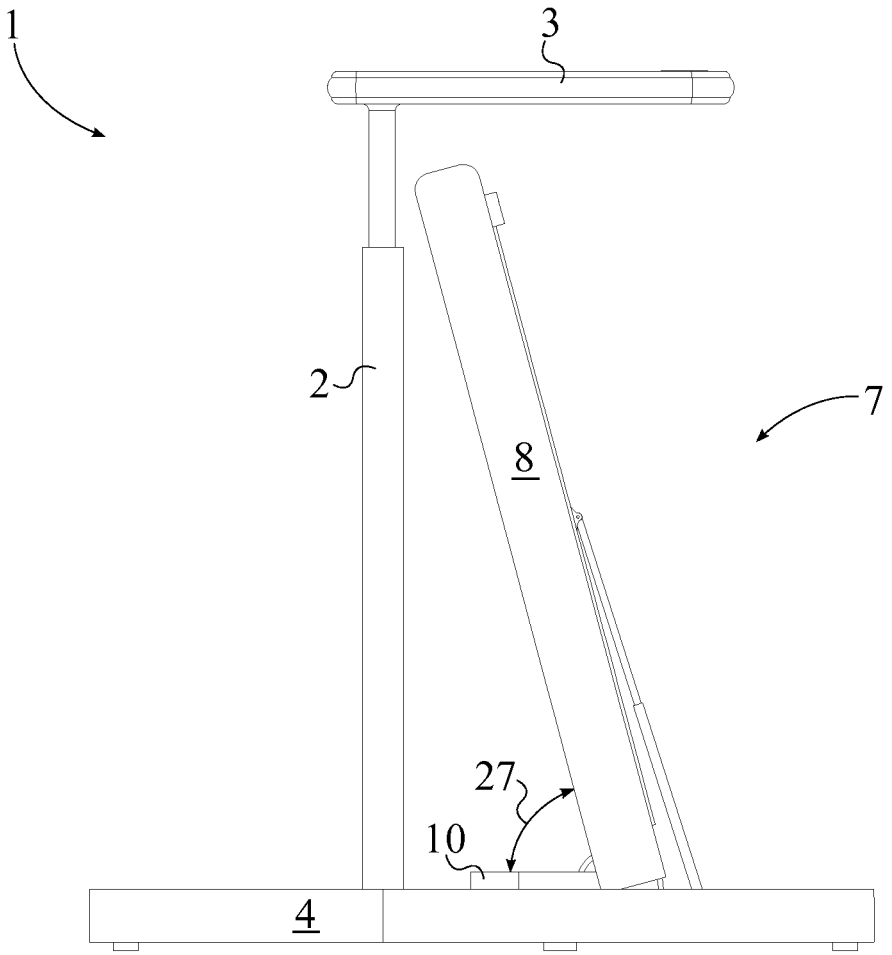
FIG. 8 is a left-side view of the present invention in the folded configuration.
Figure 9:
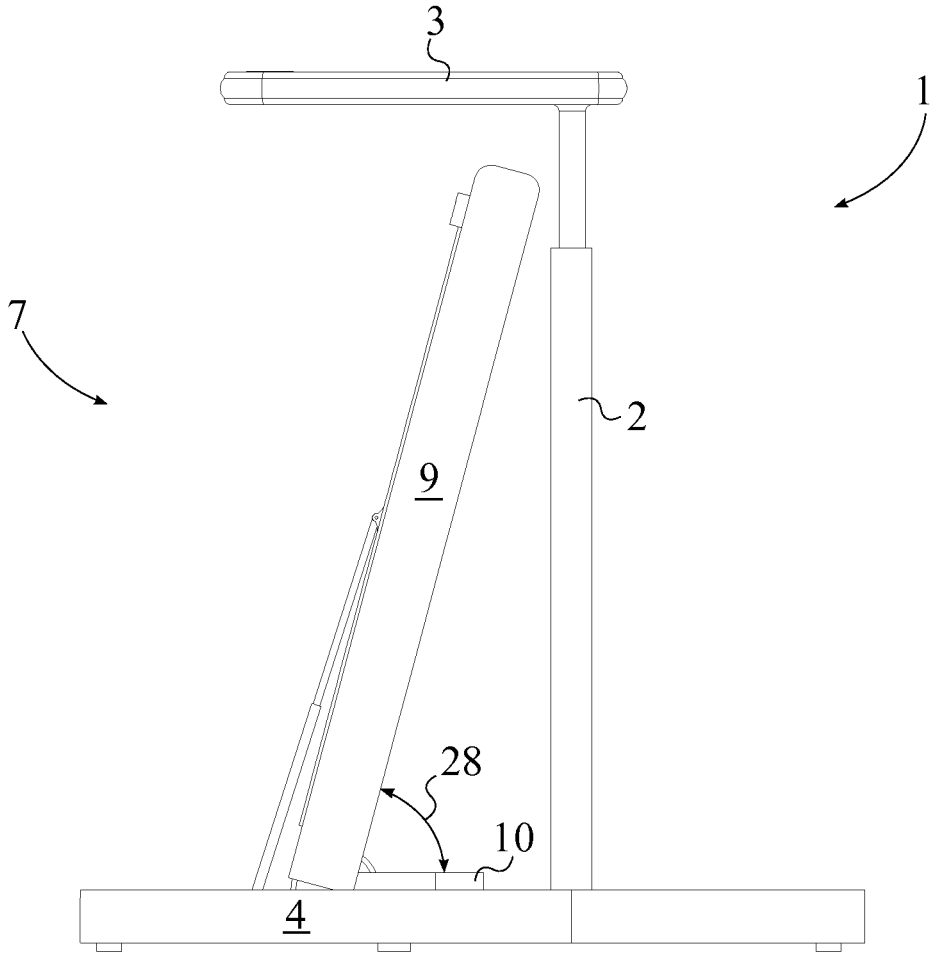
FIG. 9 is a right-side view of the present invention in the folded configuration.

Referring to FIG. 8 and FIG. 9, in one embodiment of the present invention also includes a folding feature that allows the treadmill 7 to fold upwards to be stored under the work panel 3. In this embodiment, the first guiding member 8 and the second guiding member 9 are hingedly connected to the front housing 10. This design allows the first guiding member 8, the second guiding member 9, and the attached components to rotate about the hinge connection to be positioned adjacent to the at least one adjustable leg 2, a folded configuration. More specifically, in the folded configuration the first guiding member 8 is rotated about the hinge until a first angle 27 between the first guiding member 8 and the front housing 10 is acute; simultaneously, the second guiding member 9 is rotated until a second angle 28 between the second guiding member 9 and the front housing 10 is acute as well. This positions the rear roller 13 adjacent to the at least one adjustable leg 2 as seen in FIG. 8 and FIG. 9. A locking mechanism may also be utilized to secure the treadmill 7 in the folded configuration and in an extended configuration. Various types of devices may be used for the locking mechanisms including, but not limited to, latches, slot-key mechanisms, tumbler locks, and other similar devices. To position the treadmill 7 into the folded configuration, the user simply raises the first guiding member 8, or the second guiding member 9, past a vertical orientation and engages the locking mechanism. The treadmill 7 may also include a raising mechanism which aids the user in positioning the treadmill 7 into a folded configuration. Raising mechanisms includes, but are not limited to, gas pistons, hydraulic struts, electric motors, and other similar mechanisms.

In one embodiment, the present invention further comprises a chair 40 which allows the user to quickly switch between walking and sitting. The chair 40 is integrated through the use of a support bar 39. The support bar 39 is swivelably attached to the at least one adjustable leg 2 and is preferably U-shaped such that when rotated in front of the desk 1 the user will have adequate leg room for sitting or standing. The chair 40 is swivelably attached to the support bar 39, opposite the at least one adjustable leg 2 as seen in FIG. 10. The chair 40 and the support bar 39 may be rotated about the at least one adjustable leg 2 and positioned directly in front of the desk 1 to allow the user to sit while working. This design allows the user to easily and quickly change positions and activities. Various designs may be used for the chair 40 component with varying degree of comfort to suit the needs and preferences of the user. In alternative embodiments of the present invention, the chair 40 may be attached to alternative regions of the desk 1 and or the treadmill 7 through alternative means and mechanisms. Furthermore, the chair 40 may be stand alone, not connected to either the desk 1 or the treadmill 7, and designed to be easily removable.

The treadmill 7 may also comprise a pair of first legs, a pair of second legs, a first wheel, and a second wheel. The pair of first legs and the pair of the second legs elevate the treadmill 7 and provide the necessary clearance for the belt 11 to able to rotate without any obstructions. The pair of first legs is connected perpendicular to the first guiding member 8, positioned opposite to each other along the bottom surface of the first guiding member 8. Similarly, the pair of second legs is connected perpendicular to the second guiding member 9, positioned opposite to each other along the bottom surface of the second guiding member 9. The pair of first legs and the pair of second legs are identical in shaped and height to ensure the treadmill 7 sits level. The first wheel and the second wheel are integrated into the front housing 10 and allow for the transportation of the treadmill 7. In particular, the first wheel is rotatably mounted to the front housing 10, adjacent to the pair of first legs; the second wheel is rotatably mounted to the front housing 10, adjacent to the pair of second legs. Additionally, in order to prevent the treadmill 7 from moving during operations a diameter of the first wheel and the second wheel is less than a length of the pair of first legs and a length of the pair of second legs. This ensures that the first wheel and the second wheel can only engage the floor when the treadmill 7 is raised on one side, the side opposite the front housing 10. To transport the treadmill 7, the user simply raises the side opposite the front housing 10 and pushes or pulls the treadmill 7 around.

In one embodiment, the treadmill 7 assembly also utilizes a dead man breaking feature. The feature utilizes a plurality of integrated pressure sensors to determine whether a person is on the treadmill 7 and act accordingly; when the user steps off the treadmill 7, the sensors will identify a change in weight an automatically shut off the motor 19. In this embodiment, the pressure sensors are integrated into the pair of first legs and or pair of second legs.

A variety of accessories and additional features are integrated into the work panel 3 in order to create a more convenient environment for the user. One of these features is a set of handle bars 22. The set of handle bars 22 provides the user with a grip and a means of balancing themselves while utilizing the treadmill 7. The set of handle bars 22 is laterally connected to the work panel 3 and is positioned adjacent to the treadmill 7, directly in front of the user. The preferred design comprises two longitudinal extrusion cuts into the work panel 3 to yield two cylindrical shapes such that the user may grab them in a similar fashion as bicycle handlebars; to further facilitate a more ergonomic design, the set of handle bars 22 and the regions directly surrounding the set of handle bars 22 are covered in a "soft to the touch" rubber-like material. This material selection creates engagement features that are easier to grab and hold onto; such material is also water and sweat resistant, an essential characteristic for exercise equipment. The material composition is subject to change. In alternative embodiment of the present invention, the set of handle bars 22 may comprise two elongated prongs extruded from the sides of the work panel 3 such that when the user stands on the treadmill 7, a prong/handle is located on either side of him or her. Said prongs may extend upwards, downwards, or any degree between the two.

Figure 3:
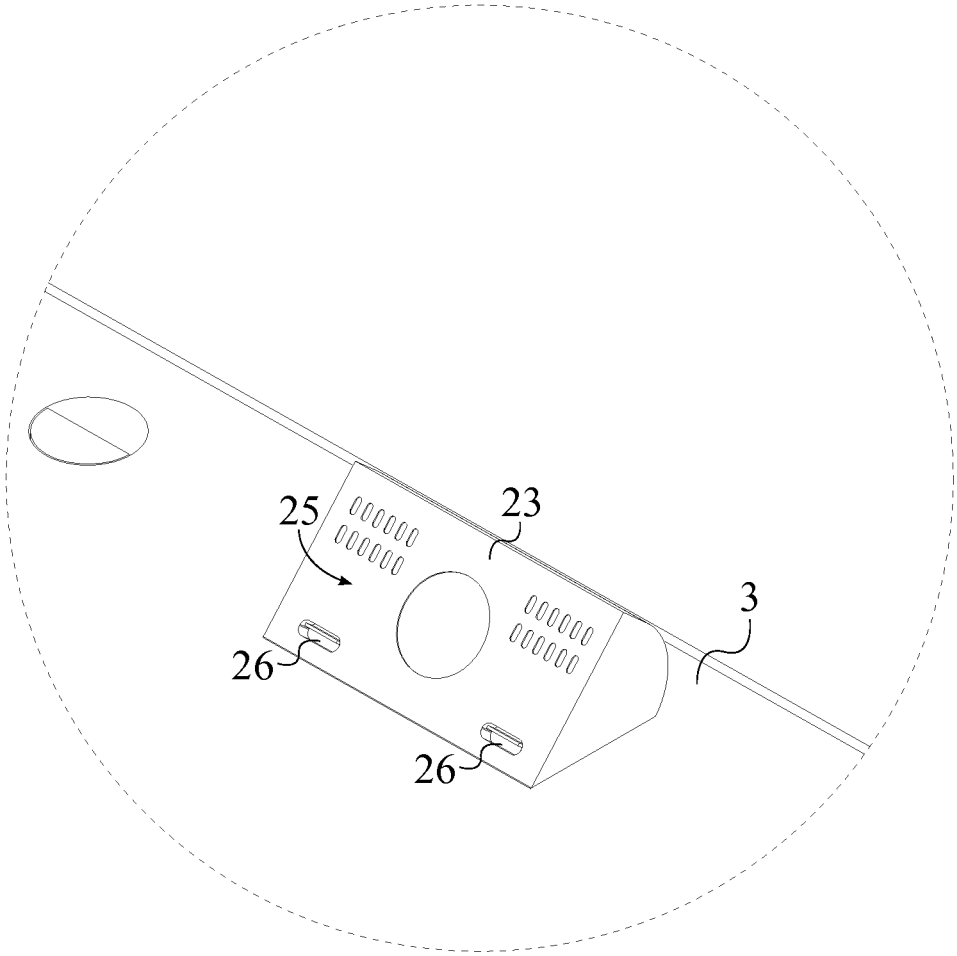
FIG. 3 is a detail view taken about circle A in FIG. 2.
Figure 4:
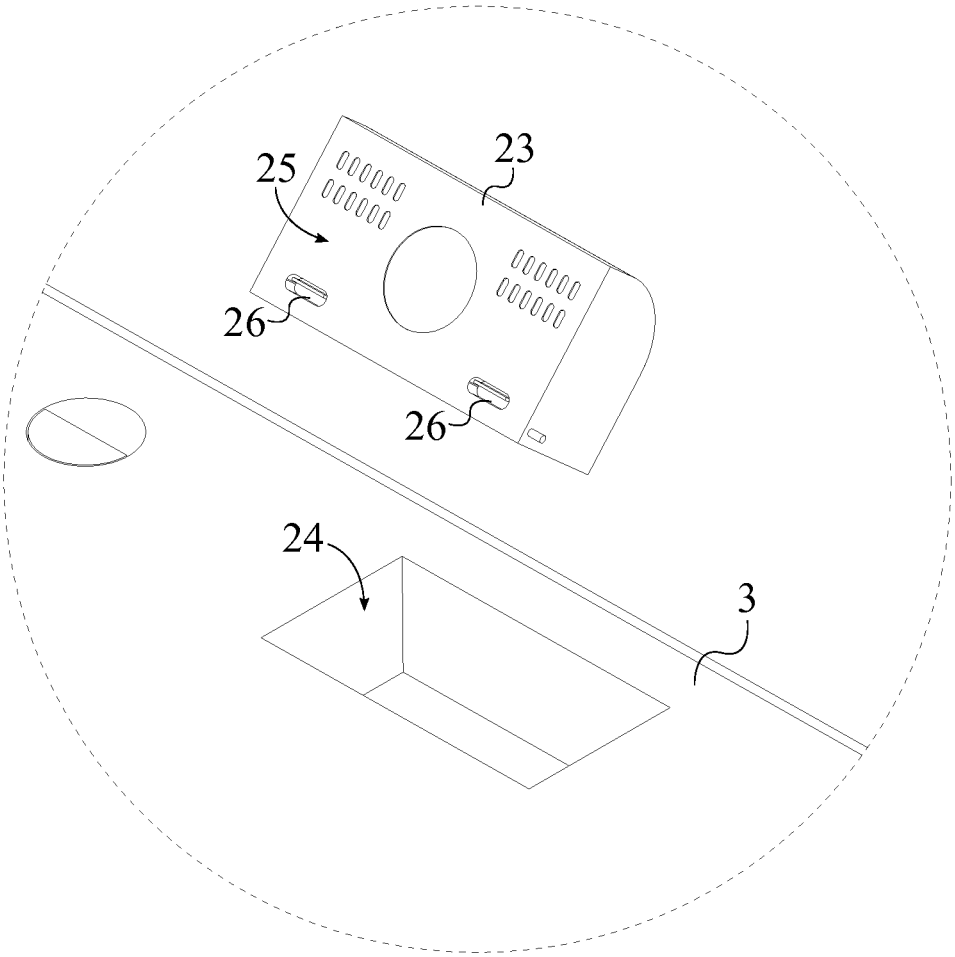
FIG. 4 is an exploded detail view taken about circle A in FIG. 2.

Additionally, an at least one Universal Serial Bus (USB) port 26 and an at least one speaker 25 is incorporated into the work panel 3 through a retractable housing 23 and a receiving cavity 24 as seen in FIG. 3 and FIG. 4. The retractable housing 23 stores and houses the aforementioned accessories. The receiving cavity 24 traverses into a top surface 6 of the work panel 3 and is shaped to receive the retractable housing 23. The retractable housing 23 is slidably engaged into the receiving cavity 24 and is hingedly connected to the work panel 3. The at least one USB port 26 and the at least one speaker 25 are integrated into the retractable housing 23, facing the external environment. Additionally, the at least one USB port 26 and the at least one speaker 25 are electronically connected to the control panel 14. The retractable housing 23 is able to be raised above the top surface 6 by a push-release spring mechanism; pushing against a top surface of the retractable housing 23 will rotate and raise the retractable housing 23 upwards to a certain degree; pushing the retractable housing 23 in the extended state will return the retractable housing 23 to the recessed state, sitting flush with the top surface 6. Various alternative mechanisms may be used for the pop-up feature of the retractable housing 23 including, but not limited to, pneumatic actuation, self-locking latching mechanisms, spring actuations, and electric motor actuation. The user may connect his or her electronic devices to the present invention through the at least one USB port 26; the at least one USB port 26 may be used to transfer data, control the present invention, charge the electronic device, and other similar functions. Additionally, the user may play his or her audio files through the at least one speaker 25. The work panel 3 preferably contains two retractable housings 23, each with one speaker 25 and two USB ports 26 as seen in FIG. 3.

In alternative embodiments, the retractable housing 23 may contain power outlets, auxiliary ports, iPhone coupling mechanisms, and may raise straight up and lower straight down instead of rotating upwards to face the user. Additional accessories that may be integrated into the work panel 3 also include cable ports, holes, cable ties, as well as an iPod deck; some alternative embodiments of the present invention allow the user to utilize various gaming consoles with the present invention and as such may contain the required electrical ports, or wireless communication capabilities.

Figure 12:
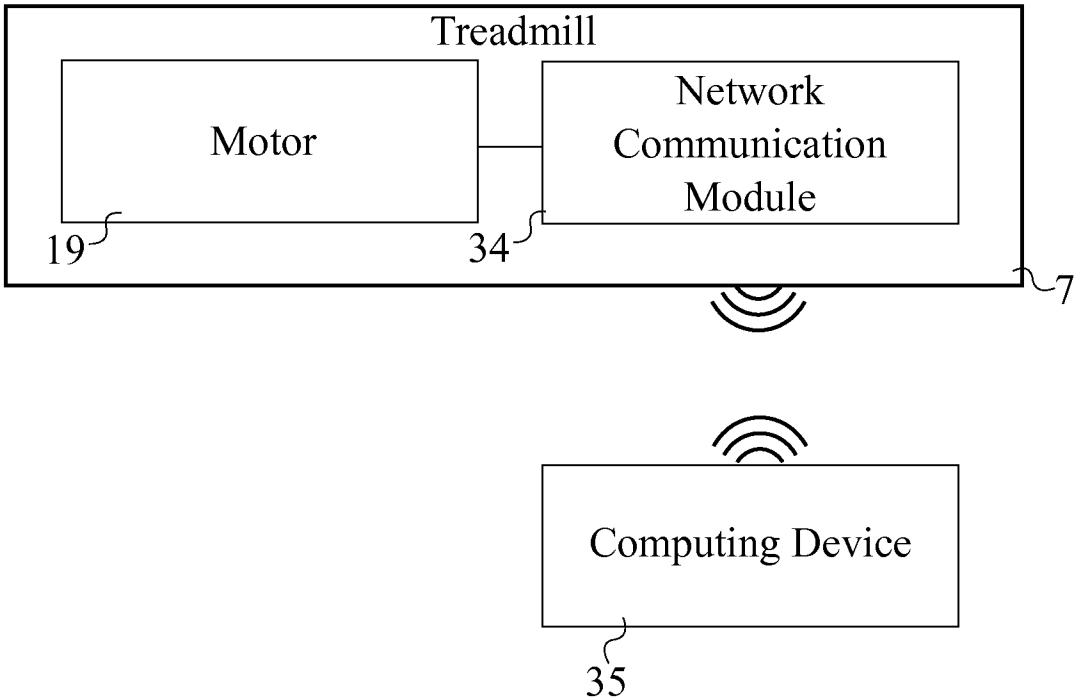
FIG. 12 is a schematic diagram of the present invention depicting the necessary components required to monitor and record the user's physical performance while engaging the treadmill.

In one embodiment, the present invention is incorporated into health/exercise incentive programs, loyalty programs, and or electronic games. Referring to FIG. 12, this is achieved through the use of a network communication module 34 and a computing device 35. The network communication module 34 is mounted within the treadmill 7 and is electronically connected to the motor 19. The network communication module 34 transmits information pertaining to the user's physical performance to the external entities for processing. One of the external entities is the computing device 35. The computing device 35 executes the game or incentive program and is communicable coupled to the network communication module 34. Preferably, the computing device 35 is located outside the treadmill 7; although in alternative embodiments the computing device 35 is integrated into the treadmill 7 or the desk 1. The computing device 35 is also connected to external companies or external entities which sponsor the aforementioned programs and or games. Various devices may be used as the computing device 35 including, but not limited to, smartphones, laptops, computers, and other electronic devices. In general, first the physical performance is monitored and recorded while the user is engaging the treadmill 7. Next, this information is sent to the computing device 35 for processing; the information is sent by the network communication module 34. The computing device 35 analyzes the physical performances as input for the various programs that he or she is participating in. Based on the physical performance, the user is presented with a corresponding award by the company sponsoring the program or game. For example, the present invention may be partnered with a company that sells athletic apparel and for every pre-set number of miles walked by the user the company offers him or her a discount on specific products sold by the company. Alternatively, the present invention may be integrated into a game being run on the computing device 35 and for every pre-set number miles walked by the user the game offers the user in-game content, for example coins and levels, for free or for a discounted rate. The present invention lends itself to other similar cooperation between the present invention and incentive programs. This motivates the user and his/her family to take advantage of the opportunities and promotes healthy exercising habits.

In another embodiment, the present invention also incorporates grounding and Earthing technology to promote stable internal bioelectrical environments for all body systems. Earthing technology allows the user to physically connect to the vast supply of free electrons located at the surface of the planet, this connection is correlated with a variety of health benefits; one such benefit is the reduction of acute and chronic inflammation. Grounding technology is integrated into the present invention through a conductive material located at the contact surface of the work panel 3. More specifically, the present invention further comprises an at least one grounding mat 36 that is integrated into the top surface 6 of the work panel 3 as seen in FIG. 10. To provide the grounding effect to user the at least one grounding mat 36 is electrically connected to a grounding terminal 37 of an electrical outlet 38 as seen in FIG. 11, thus connecting the user's body to the surface of the Earth; it is required that the electric outlet 38 is connected to the Earth's surface. The at least one grounding mat 36 is preferably located closed to the set of handle bars 22 so as to come in contact with the user's skin more often. In one embodiment of the present invention, grounding elements are integrated into the belt 11 such that the user may walk barefoot on the treadmill 7 and be connected to the surface of the Earth.

In an alternative embodiment, various components may be modular and allow the user to customize to his/her liking. Components include, but are not limited to, walking belt, handles, side skirts, table top. The components would contain an outer surface that is easily replaceable or the component itself would be easily removable as to allow the user to buy different colored and or patterned components/surfaces to replace on their machine, thus increasing customizability.

The present invention also lends itself to compatibility with various audio, video, and gaming devices. The present invention may be configured to be able to work with 3D based immersion technology where the physical rotation of the belt 11 is transformed into a specific input of a game being executed on the computing device 35. For example, when incorporated into a first person shooter the rotation of the belt 11 is used to translate the character within the environment of the game. Additionally, the present invention may be compatible with external projection devices which project the video onto a wall while the user interacts with it through a controller. These compatible technologies may come pre-installed onto the machine or may come in the form of a retrofit kit. In an alternative embodiment, the treadmill 7 of the present invention may convert the rotational motion into electric energy and store it in an auxiliary battery. When enough energy is stored, the present invention may then be used to power the treadmill 7 and/or the associated accessories of the present.

Although the invention has been explained in relation to its preferred embodiment, it is to be understood that many other possible modifications and variations can be made without departing from the spirit and scope of the invention as hereinafter claimed.

What is claimed is:

1. A desk workstation with an integrated treadmill comprises:

a desk;

a treadmill;

the desk comprises an at least one adjustable leg, a work panel, a base frame, and a treadmill-receiving cavity;

the treadmill comprises a first guiding member, a second guiding member, a front housing, a belt, a front roller, a rear roller;

the at least one adjustable leg being oriented normal to the work panel;

the at least one adjustable leg being adjacently connected to the work panel;

the base frame being adjacently connected to the at least one adjustable leg, opposite the work panel;

the treadmill-receiving cavity laterally traversing into the base frame;

the first guiding member and the second guiding member being oriented perpendicular to the front housing;

the first guiding member and the second guiding member being adjacently connected to the front housing;

the front roller being rotationally mounted in between the first guiding member and the second guiding member, adjacent to the front housing;

the rear roller being rotationally mounted in between the first guiding member and the second guiding member, opposite the front housing;

the belt being tensionably positioned about the front roller and the rear roller;

the front housing being positioned within the treadmill-receiving cavity; and the front housing being removably attached to the base frame.

2. The desk workstation with an integrated treadmill as claimed in claim 1 comprises:

a first engagement element;

a second engagement element;

the first engagement element being laterally connected to the front housing, adjacent to the first guiding member;

the second engagement element laterally traversing into the base frame from the treadmill-receiving cavity, adjacent to the first engagement element; and the first engagement element being interlocked into the second engagement element.

3. The desk workstation with an integrated treadmill as claimed in claim 1 comprises:

a third engagement element;

a fourth engagement element;

the third engagement element being laterally connected to the front housing, adjacent to the second guiding member;

the fourth engagement element laterally traversing into the base frame from the treadmill-receiving cavity, adjacent to the third engagement element; and the third engagement element being interlocked into the fourth engagement element.

4. The desk workstation with an integrated treadmill as claimed in claim 1 comprises:

a control panel;

a motor;

a first wireless communication device;

a second wireless communication device;

the motor being mounted within the first guiding member, adjacent to the front roller;

the motor being torsionally coupled to the front roller;

the control panel being integrated into a top surface of the work panel;

the first wireless communication device being integrated into the work panel;

the first wireless communication device being electronically connected to the control panel;

the second wireless communication device being integrated into the treadmill;

the second wireless communication device being electronically connected to the motor; and the second wireless communication device being communicably coupled to the first wireless communication device.

5. The desk workstation with an integrated treadmill as claimed in claim 1 comprises:

a set of handle bars;

the set of handle bars being laterally connected to the work panel; and the set of handle bars being positioned adjacent to the treadmill.

6. The desk workstation with an integrated treadmill as claimed in claim 1 comprises:

a retractable housing;

a receiving cavity;

an at least one speaker;

an at least one Universal Serial Bus (USB) port;

the receiving cavity traversing into a top surface of the work panel;

the retractable housing being slidably engaged into the receiving cavity;

the retractable housing being hingedly connected to the work panel; and the at least one USB port and the at least one speaker being integrated into the retractable housing.

7. The desk workstation with an integrated treadmill as claimed in claim 6 comprises:

the at least one USB port and the at least one speaker being electronically connected to a control panel.

8. The desk workstation with an integrated treadmill as claimed in claim 1 comprises:

the first guiding member and the second guiding member being hingedly connected to the front housing.

9. The desk workstation with an integrated treadmill as claimed in claim 8 comprises:

wherein the first guiding member and the second guiding member are positioned into a folded configuration;

a first angle between the first guiding member and the front housing being acute;

a second angle between the second guiding member and the front housing being acute; and the rear roller being positioned adjacent to the at least one adjustable leg.

10. The desk workstation with an integrated treadmill as claimed in claim 1 comprises:

a length of the front roller;

a length of the rear roller;

an offset distance between the front roller and the rear roller;

a ratio between the offset distance and the length of the front roller being a range from 0.75:1 to 1:1;

a ratio between the offset distance and the length of the rear roller being a range from 0.75:1 to 1:1; and the length of the front roller being equal to the length of the rear roller.

11. The desk workstation with an integrated treadmill as claimed in claim 1, wherein a thickness of the belt ranges between three fourths of an inch to one and three fourths of an inch.

12. The desk workstation with an integrated treadmill as claimed in claim 1 comprises:

the treadmill further comprises a plurality of soft protrusions;

the plurality of soft protrusions being externally distributed across the belt; and the plurality of soft protrusions being externally connected to the belt.

13. The desk workstation with an integrated treadmill as claimed in claim 1 comprises:

a network communication module;

a computing device;

the motor being electronically connected to the network communication module; and the network communication module being mounted within the treadmill;

the network communication module being communicably coupled to the computing device; and the computing device being located outside the treadmill.

14. The desk workstation with an integrated treadmill as claimed in claim 1 comprises:

an at least one grounding mat;

the at least one grounding mat being integrated into a top surface of the work panel; and the at least one grounding mat being electrically connected to a grounding terminal of an electrical outlet.

15. The desk workstation with an integrated treadmill as claimed in claim 1 comprises:

a chair;

a support bar;

the support bar being swivelably attached to the at least one adjustable leg; and the chair being swivelably attached to the support bar, opposite the at least one adjustable leg.

* * * * *